US007255244B2

(12) United States Patent
Miller

(10) Patent No.: US 7,255,244 B2
(45) Date of Patent: Aug. 14, 2007

(54) PAINT SEALER FOR USE WITHIN PAINT CANS

(76) Inventor: Clifton Leigh Miller, 50 Cottons Drive, Little Swanport, Tasmania 7190 (AU)

( * ) Notice: Subject to any disclaimer, the term of this patent is extended or adjusted under 35 U.S.C. 154(b) by 561 days.

(21) Appl. No.: 10/822,880

(22) Filed: Apr. 7, 2004

(65) Prior Publication Data

US 2004/0238544 A1 Dec. 2, 2004

Related U.S. Application Data

(63) Continuation of application No. PCT/AU02/00709, filed on Jun. 4, 2002.

(51) Int. Cl.
*B65D 25/10* (2006.01)
*B65D 53/00* (2006.01)
*B65D 81/24* (2006.01)

(52) U.S. Cl. ..... 220/578; 220/222

(58) Field of Classification Search ..... 220/216, 220/221, 222, 224, 578, 579, 580, 570, 629; 222/386

See application file for complete search history.

(56) References Cited

U.S. PATENT DOCUMENTS 3,924,774 A * 12/1975 Donnelly ..... 220/580
4,312,459 A * 1/1982 Leach ..... 220/256.1
4,416,387 A * 11/1983 D'Antonio ..... 220/579

* cited by examiner

*Primary Examiner*—Anthony D. Stashick
*Assistant Examiner*—Harry A Grosso
(74) *Attorney, Agent, or Firm*—Francis Law Group

(57) ABSTRACT

The present invention provides for a device for sealing paint in a can. The device or fluid cover includes a circular disk having an outer edge with the diameter of the edge being smaller than the inner diameter of the can. The cover includes a side wall that extends outwardly and upwardly and a lip that extends radially outwardly from the side wall. The diameter of the lip is greater than the inner diameter of the can. Upon insertion of the cover into the can the side wall flexes to allow the cover to be inserted into the can, whilst the lip frictionally engages the can inner surface. The fluid cover further includes a handle defining an upward cavity that can be compressed to expel air from the cavity and assists in sealing the fluid cover on top of paint by providing a partial vacuum. The side wall may be of an arcuate shape and have several sections extending radially outwardly at different angles to the disk.

17 Claims, 3 Drawing Sheets

PAINT SEALER FOR USE WITHIN PAINT CANS

This application is a continuation application of International Application No. PCT/AU02/00709, filed Jun. 4, 2002, which claims priority from Australia Application No. PR5518, filed Jun. 6, 2001.

The present invention relates to a paint sealer for use within paint cans and in particular to a paint sealer that provides an effective seal so as to preserve the paint, the seal remaining air tight even when the can experiences a tilt.

BACKGROUND OF THE INVENTION

The present invention relates to the preservation of paint in containers. However it could equally well be applied to the preservation of any other fluids and/or solids within an enclosed circular container or can, or other protective fluids such as varnish and lacquers. Although the following description deals with paint it is therefore to be understood that it is not intended to limit the invention to preserving of paints.

The following description refers to a paint sealer as a fluid cover. It is however to be understood that this relates to the same device and it is not intended to distinguish one from the other. Further, other terms to describe the invention may equally well be used, such as a lid or a seal. The present invention therefore relates to a device that is placed on top of paint in a can that has been partially used and that seals the paint from the outside air.

Paints are typically housed in cylindrical metal containers or cans. The cans come in a range of sizes, with the bigger sizes in Australia typically being cans whose volume is 4 litres, 10 litres or 20 litres.

The sealable top lid prevents paint from drying or skinning when a can is nearly full but as the contents are used over time the ratio of paint to residual air in the can changes. The air is responsible for allowing the paint to partially evaporate, dry out, or form a thick skin on top. Whilst the problem in commercial applications may not be as great, most paint being used within several days, paint may be stored in cans for years to be used either for re-coating or for touching up an existing area.

In response to this problem, there have been proposed many devices that protect the paint regardless of its level within a can. Some of these devices are quite complex mechanical contraptions that by their very nature are difficult to use and are expensive. Yet other devices provide for floating disks that provide separation of the partially filled contents of a can from the air above while in storage. These disks are generally circular and are designed to fit within the can and float upon the residual contents of the can. Some of these have included features for increasing the friction between the device and the can walls but they do not entirely remove unwanted air from being in contact with the paint nor do they accommodate the can from being tilted.

In addition, only a few of these floating disk or fluid cover solutions have understood the need to achieve a complete seal of the paint. A fluid cover that merely passively floats upon the surface of paint will not prevent the loss of evaporative components from around the edge of the fluid cover. Evaporates take gaseous form and are lighter than air, thereby passing into the vacant portion of the can. The larger the volume of air in the can, or the more frequently the can is opened the more serious becomes the loss of evaporates. Also, none of these devices have addressed the need for a fluid cover that accommodates cans that may not be perfectly circular and whose cross-sectional shape may vary.

The author is aware of only one device that has been designed to achieve a complete seal. This device, described in U.S. Pat. No. 4,416,387 by D'Antonio, relies on the paint itself to fill the gaps at the perimeter of the device in order to properly attain a seal. That is, the paint at the edge of the fluid cover dries thereby protecting the paint within the can. A partial vacuum then assists to keep the fluid cover in place. To accomplish this, D'Antonio provides for an outer flange having a slightly larger diameter than the can. There are several difficulties in the aforementioned design by D'Antonio.

Firstly the fluid cover does not accommodate cans whose cross-sectional size may vary. The fluid cover as taught by D'Antonio includes a central portion having a raised central axial squeeze section, a flat circular channel surrounding said flat portion and defined by two upward walls, a narrow sealing flange then extending horizontally from the outer one of those two walls. Such an arrangement does not allow for flexibility of the fluid cover in the horizontal plane, which is necessary in cans whose cross-sectional shape is not perfectly circular. D'Antonio's seal is simply incapable of flexibly expanding or contracting to take up the irregularities encountered in typical paint can wall shapes. It is not uncommon for can diameters to vary by upwards of 1.0 mm or so. The teaching of the low profile channel by D'Antonio in fact helps to maintain the shape of the fluid cover. In addition, the method of forming the device described by D'Antonio involves a heat treatment of plastic film that upon withdrawal from the die cools and shrinks. It is well known that the pulling of the device to achieve a raised central air expulsion portion will cause outer perimeter shrinkage that is unevenly distributed about the circumference of the device. This means that a non-circular seal will be inserted into a non-circular can, the consequences being that random circumstance will determine whether or not a good seal is obtained. If the fluid cover is manufactured of non-circular shape, as is common in low cost high volume plastic die operations, this further limits the usefulness of the fluid cover as taught by D'Antonio.

Secondly, the device taught by D'Antonio requires that there be a wetting of the seal edge by the can contents in order to attain a proper seal. The paint then dries meaning that a can whose contents are often accessed ends up with dried paint layers on the side. In addition, even where the seal matches perfectly the internal configuration of the can there is no means provided for retaining the seal against the can wall during any subsequent tilting of the can. Mere contact does not achieve this, and partial vacuum alone will not force adherence between two bodies while greater force than the friction so obtained is brought to bear. The fluid cover taught by D'Antonio therefore does not assist in securely sealing the paint when the can is tilted as may be expected during normal handling of the can.

Accordingly none of the prior art known to the applicant provides a fluid cover that successfully seals a liquid in a partially empty cylindrical can even when the can is tilted after applying the fluid cover, nor are they capable of accommodating cans whose internal shape may not be suitably circular.

It is the object of the present invention to overcome at least some of the abovementioned problems or provide the public with a useful alternative.

It is a further object of the present invention to provide a paint fluid cover for use in a can that seals paint even where the can walls may not be perfectly circular and where the fluid cover remains in place during normal carrying and tilting of the can.

SUMMARY OF THE INVENTION

Therefore in one form of the invention there is proposed a device for sealing a substance in a container, said container having a base and a cylindrical wall extending upwardly from said base, said wall including an inner surface being of an inner diameter, said device including:

a circular disk, said disk having an outer edge, the diameter of said outer edge being smaller than the diameter of said wall inner surface;

a side wall extending outwardly from said disk outer edge, said side wall having an outer edge, said side wall including at least one section extending angularly to said disk;

a lip extending generally horizontally from said side wall outer edge the diameter of the lip being greater than the diameter of said disk inner surface wherein upon insertion of said device into said container, the side wall is caused to flex to allow for said lip diameter, said lip frictionally engaging the inner surface of said container wall.

In preference the side wall extends angularly upwardly from said circular disk.

In preference the side wall outer edge diameter is greater than the diameter of the inner surface of the can wall.

Preferably the side wall is of an arcuate shape.

In preference the side wall has at least three sections, at least one of which extends outwardly at a different angle to the other two.

Advantageously one section extends outwardly at a smaller angle than the other two sections.

Advantageously the device includes a handle to enable for the insertion and removal of said device from the can, said handle extending upwardly from said disk.

In preference the handle defines a cavity, said handle being compressible.

In preference the handle is in fluid communication through the disk outer edge wherein compressing the handle causes at least some of the air to be evacuated from said cavity and by the lip and subsequent release of the handle causes a partial cavity that aids in the sealing of the device in the container. In preference said substance is paint.

In a further form of the invention there is proposed a device for sealing paint in a can, said device including:

a flat circular disk having an upper and a lower surface said device intended for fitment within said can wherein the lower surface presents a flat surface for seating on the paint when said can is generally vertical, said disk including a circular side wall extending radially angularly upwardly, said side wall having an arcuate profile and including an outer horizontal rim adapted to contact the can wall, said rim having a perimeter diameter that exceeds the diameter of the can.

Preferably the rim perimeter exceeds the diameter of the can by an amount of some 1.0 percent.

Preferably the circular side wall extends radially angularly upwards at an angled rise of not less than 10 percent of the can internal diameter.

Preferably the device includes a control capable of functioning both as a handle to assist insertion of the device and as a squeeze chamber to assist with air expulsion during insertion of the device.

Preferably control means includes a raised cross-sectional mid-portion carried to the extremity of the flat underside of the device in the form of two raised rib members.

Preferably said device is made from moulded thermoplastic plastics.

Preferably said device is made from transparent material.

BRIEF DESCRIPTION OF THE DRAWINGS

The accompanying drawings, which are incorporated in and constitute a part of this specification, illustrates an implementation of the invention and, together with the description, serves to explain the advantages and principles of the invention. In the drawings.

DESCRIPTION OF THE PREFERRED EMBODIMENTS

Figure 1:
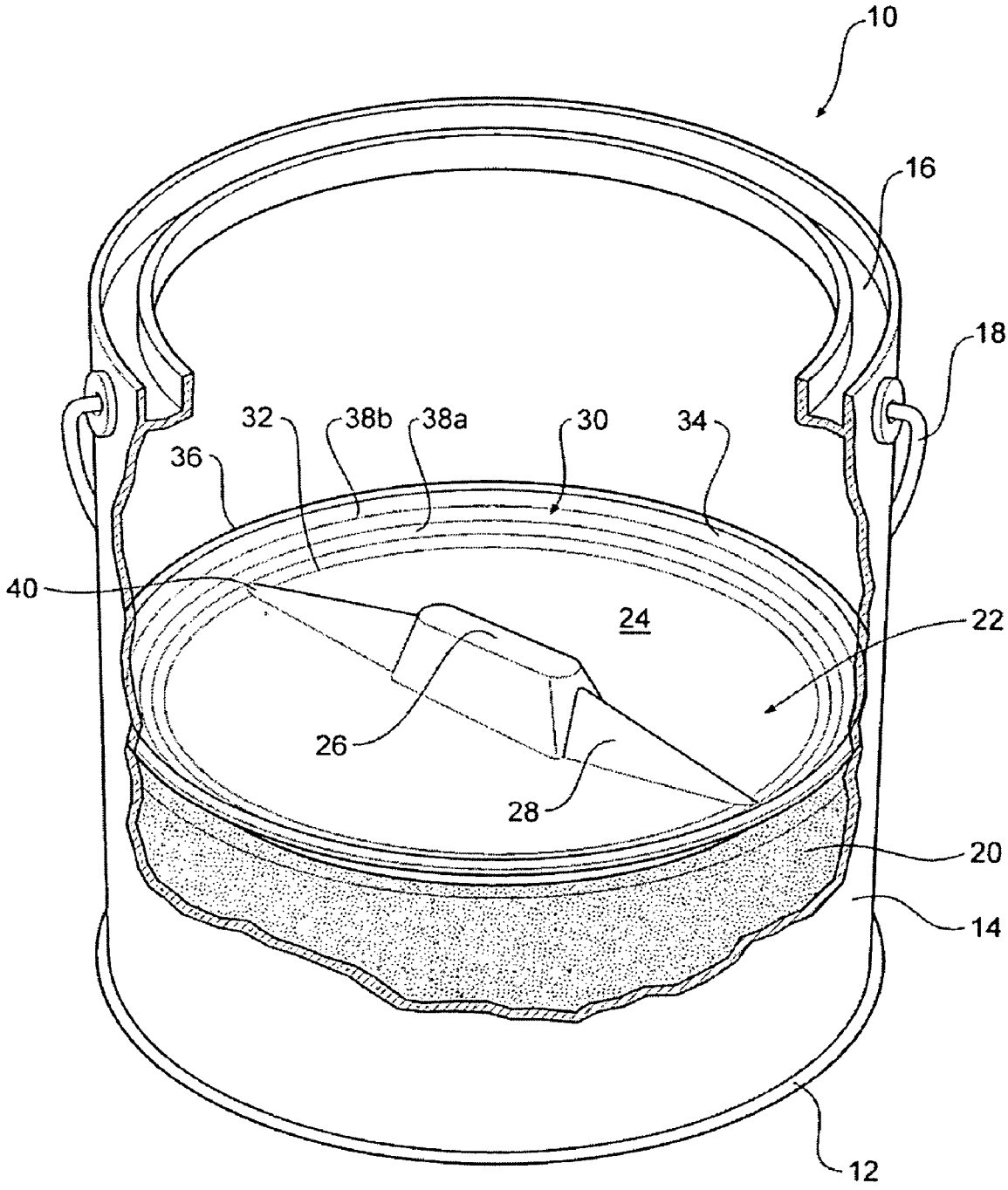
FIG. 1 is a perspective view of an uncovered conventional paint can with a cut-away portion illustrating the use of a fluid cover embodying the present invention.
Figure 2:
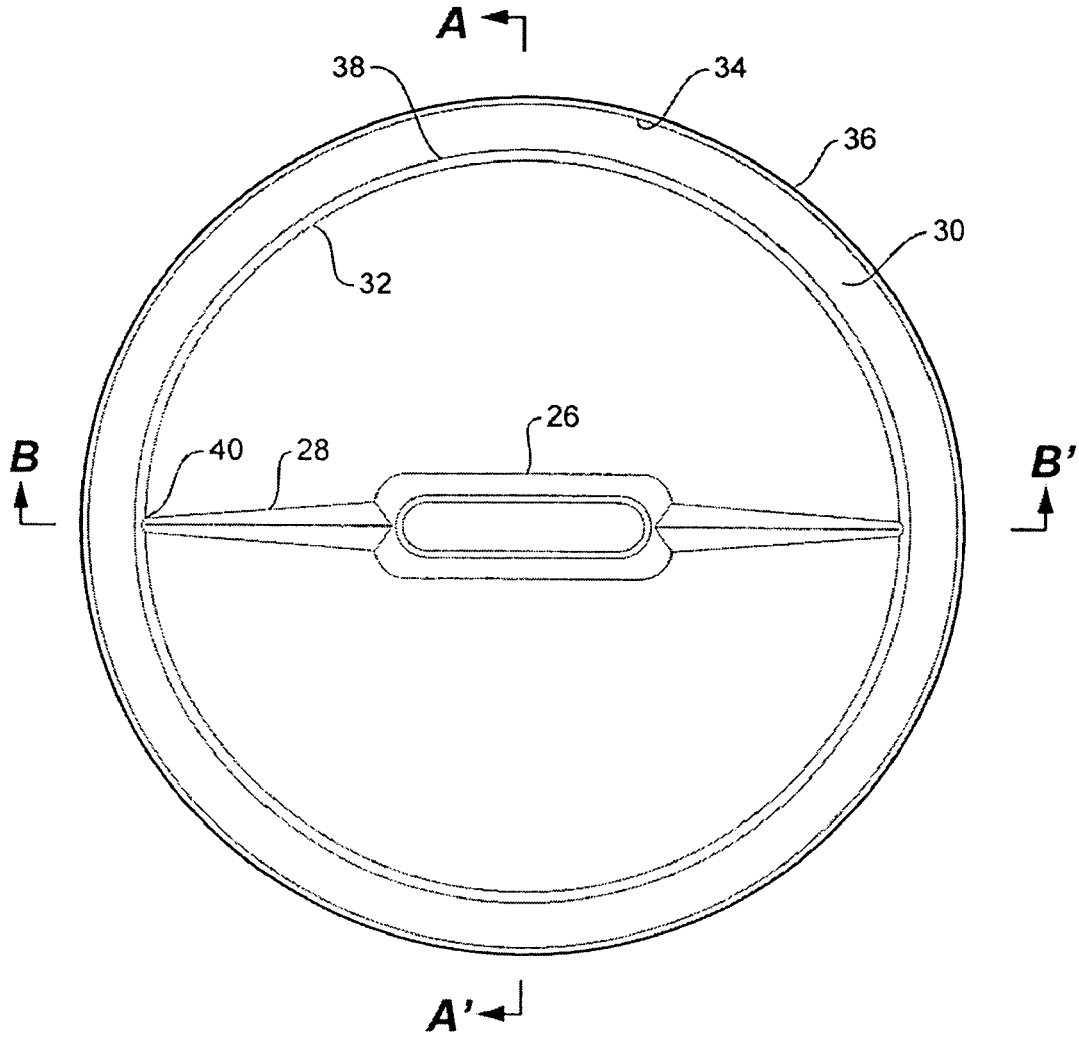
FIG. 2 is a top view of the fluid cover according to the present invention.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Turning now to the drawings in detail there is shown a paint can 10 having a base 12 and a circular wall 14 extending upwardly from said base. The wall 14 terminates in a rim 16 that is configured to receive the lip of a cover-lid (not shown). Handle 18 assists in carrying the can.

According to the present invention a device 22 is located on top of the paint 20. The device includes a disk 24 having a central raised longitudinal handle 26 extending upwardly from disk 24 and defining a cavity. The handle extends along said disk. Two side chambers 28 taper downwardly from each side of the handle 26 to the edge of the disk 24, the side chambers 28 having an apex. It is to be understood that the cross-sectional shape of the handle and/or the side chambers may vary provided that their functionality, as discussed below, is not compromised.

A circular side wall 30 extends outwardly and upwardly from edge 32 of the disk to an outer edge 34. A lip 36 then extends radially outwardly from outer edge 34 of the side wall 30. It is the lip that makes contact with the can wall 14 to assist in the seal. The outer diameter device including the lip is fractionally larger than the inner diameter of the can.

Figure 3:
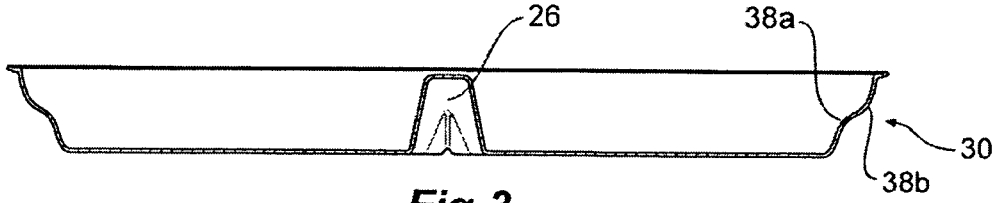
FIG. 3 is a sectional view of the fluid cover of FIG. 2 taken in the direction A-A'.
Figure 4:
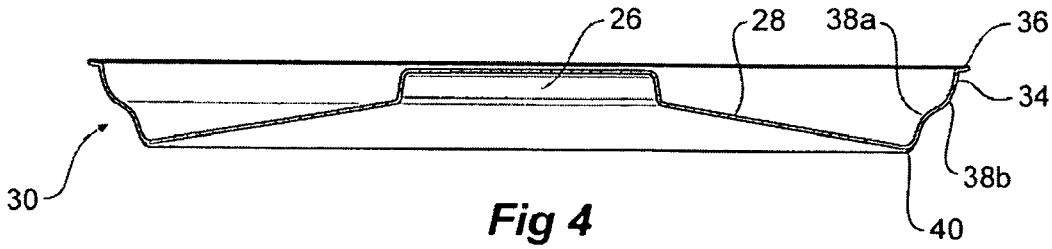
FIG. 4 is a sectional view of the fluid cover of FIG. 2 taken in the direction B-B'.

The side wall is of a non-linear but arcuate shape having three sections divided by two bends 38*a* and 38*b*. The typical shape of the side wall can be more clearly seen in FIG. 3 where the first section of the side wall extends outwardly and upwardly from disk edge 32, the second section then bending horizontally from bend 38*a*, the third section then bending more upwardly towards the vertical plane from bend 38*b*, the side wall ending at outer edge 34.

Those skilled in the art will appreciate that the actual shape of the side wall may include alternative configurations. However, the side wall is to be of an arcuate shape and include portions that extend diagonally to the plane of the disk. This enables the side wall to move in the radial direction of the disk towards and away from the wall 14 of the can thereby accommodating cans whose walls may not be perfectly circular.

The configuration of the side chambers 28 is such that where the side chambers meet the side wall or the disk outer edge 32, there is a small gap allowing for fluid communication between the cavity defined by the handle 26 and side chambers 30 to the underside of the side wall 30 and lip 36.

Figure 5:
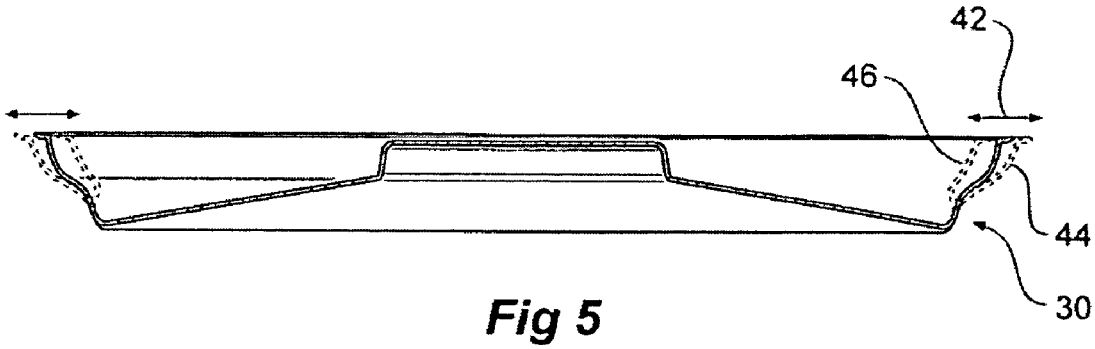
FIG. 5 is a sectional view of the fluid cover as in FIG. 4 but illustrating the flexibility of the fluid cover.

As already stated, when the device according to the present invention is inserted into a can, the configuration of the side walls accommodates can walls that may not be perfectly circular or are in fact slightly smaller than the outer diameter of the present device. The side wall, as shown in FIG. 5, may move in the radial direction 42 from an extended configuration 44 to a compressed configuration 46, the shape of the side wall conforming to the shape of the can wall. Although not shown, it is to be noted that when the side wall is pressed radially inwardly the lip 36 will in fact be slightly raised, since the side wall will have a larger vertical extent.

Figure 6:
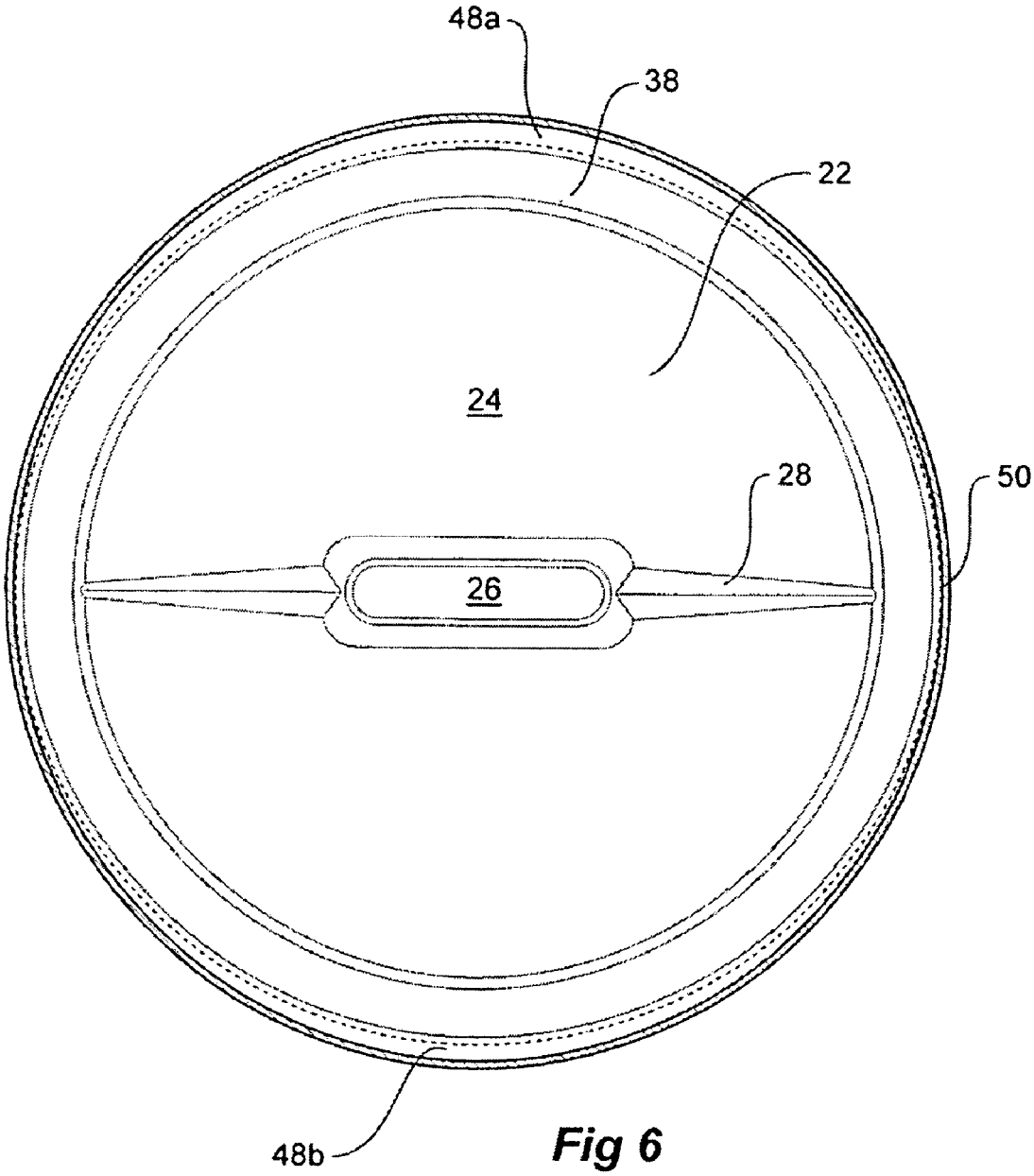
FIG. 6 illustrated the fluid cover when positioned in a non-circular can.

Thus the present invention may be used in cans where the outer diameter is non-circular as illustrated in FIG. 6, where such a can may include areas where use of a conventional floating disk would leave gaps 48*a* and 48*b*, whilst leaving no gap at location 50.

In use, a person grips the outside of the handle 26 and presses downward into the can. Since the device is of a larger diameter than the can inside diameter, the lip engages the walls of the can, the side wall flexing to accommodate this effectively locking the seal perimeter. Compressing the handle expels air from the cavity through the side chambers, gap, and around the lip to be expelled from the can. With the lip of the device in contact with the can wall, as the pressure on the cavity is removed, a partial vacuum is then created assisting in locking the device in place.

The locking of the device embodying the present invention to the walls of the can therefore involves a combination of mechanical pressure brought about by achieving a total seal diameter that is a small but significant percentage greater than the nominal diameter of the intended host can, and a mechanism for allowing the seal perimeter to flex, take up the irregular shape of the paint can and simultaneously allow for the removal of air from underneath the seal so that a partial vacuum is employed to enhance the grip of the device upon the walls of the host container.

The importance of being able to lock the seal perimeter to the internal walls of the container cannot be overstressed. This is because of the need to maintain a seal on top of the liquid both while the can is in its vertical alignment and thus the surface of the liquid contents approximates a circle in shape as well as while the can is tilted, albeit only momentarily, while being moved and at which point the surface geometry of the liquid is that of an ellipse.

A tilted can generally allows the force of flowing liquid to rupture any seal that is not firmly anchored to the walls of the host container. Once the contact circumference is ruptured, the circular seal has only two points of contact with the walls of the container, along its pivot axis, and is thus likely to float to a new anchoring position within the can. When the can is returned to the vertical position the seal may have become completely dislodged, hung up by friction with old paint on the can walls and thus unable to resume its intended horizontal relation with the liquid in the can.

The device described having a flexible lip or rim 36 that contacts the can wall 14 is further enhanced by two related features of the present invention.

The first is that when the flexible lip 36 contacts the can member the lip is raised from the bed of the disk 24 by a height equivalent to at least ten percent of the internal diameter of the host can. The manner of this raising is also of significance. It has been found in trials that single or multiple angularity of the raised wall makes the perimeter too stiff to then obtain a proper grip on the can walls. The typical film of the desired thickness for thermoforming will not flex either to adequately compensate for out-of-round cans or for out-of-round seals, and minor oversize or undersize can diameters. By contrast, a built-in arcuate shape in the side wall 30 profile provides a multiplicity of effective diameter dimensions for the outer perimeter lip or rim 36 to best accommodate the previously mentioned variables. It does this by allowing the outwardly aligned lip to achieve a degree of rise and fall around the can interior so that together with its over-sizing relative to the can wall diameter the "slack" can be taken up without causing the perimeter of the device to buckle or flex and thereby lose the partial vacuum sealing properties.

Secondly, provided that the material from which such a device is manufactured is flexible enough, gentle downwards pressure at the centre while the device is being forced into the can 10 will ensure the achieving of a partial vacuum once the downwards force ceases. Excess air will have passed up the sides of the can around the perimeter of the lip while its centre is flexed downwards and thus its total diameter is partially compromised. The partial vacuum is then enhanced by squeezing the central handle 26 together with the side chambers or air channels 28 that carry excess air to the outer raised perimeter section thereby enhancing the ability to push the device into the can.

The manner and method of removal of the device from the can is also illustrative of the principle of the varied internal geometry possible within a cylinder. Many examples of previous attempts to provide paint seals have involved elaborate means for releasing suction or flexing the device away from the can walls in order to achieve removal from the can. Provided a paint seal has sufficient rigidity to allow for it, the best method for removal of the seal is simply to force it to take up the ellipse shape relative to the circle described by the horizontal surface of the paint. To do this, one edge is simply pushed firmly downwards into the paint and the opposite edge rises for easy hand grip and hence removal, despite some small amount of paint which is now likely to find itself on the upper surface of part of the seal. This removal process also illustrates the significance of the ellipse that the liquid describes when the can is tilted and thus the ease with which passively floating seals will be disrupted during storage life. Indeed, by taking advantage of the ellipse it is possible to tilt the can before removal of the seal, push the seal inwards on its upper extremity, and avoid any paint over-topping the seal while it is being removed from the can.

In summary then, the features of the present invention of a device for preserving paint in a partially emptied can relate to a combination of at least some of the following features:

- an over-sized perimeter diameter of the device relative to its intended host can, said device requiring some mechanical force to properly seat it within the can;
- a narrow, horizontal outer lip that makes the point of contact with the can walls;
- an outwardly angled, circular, rise that supports the outer lip and connects it to the main body of the seal which lies upon or adjacent the paint surface, said rise incorporating a wave-like or arcuate profile, said rise extending sufficiently above the surface contact area of the main body of the seal to provide a multiplicity of cross-centre seal diameter dimensions such as will allow the seal to conform to irregular non-circular internal wall shapes as well as other irregularities such as that imposed by any non-circularity in the seal itself.

Provided that the whole of the above described features are adhered to, and provided only that some means is provided for expelling residual air from underneath the device, a combination of partial vacuum and firm mechanical fit will allow a device such as this to provide a seal to lock any liquid within its host container so that even when the host container is accidentally knocked over or even turned upside down the liquid will be retained in the original portion of the can and will not force the seal to rupture. Thus the seal so described will at least be capable of substituting entirely for the original top lid of the can which may well have become partially ineffective due to dried paint in the sealing lip or have rusted out.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

The invention claimed is:

1. A device for sealing a substance in a container, said container having a base and a cylindrical wall extending upwardly from said base, said wall including an inner surface having an inner diameter, said device including:

a circular disk, said disk having an inner surface and outer edge, the diameter of said outer edge being smaller than the diameter of said container wall inner surface; and a flexible seal perimeter, said seal perimeter having a side wall extending outwardly and upwardly from said disk outer edge, said side wall including at least three sections and an outer edge, at least one of said wall sections extending outwardly and angularly to said disk at a first angle and at least one of said wall sections extending angularly to said disk at a second angle, and a lip extending generally horizontally from said side wall outer edge, the diameter of said lip being greater than the diameter of said disk inner surface, wherein upon insertion of said device into said container, said side wall is caused to flex to allow for said larger lip diameter and said lip frictionally engages said inner surface of said container wall, whereby a sealed device and container wall interface is provided, said sealed interface being maintained during non-vertical and inverted orientations of said container.

2. The device of claim 1, wherein said side wall extends angularly upwardly from said circular disk.

3. The device of claim 1, wherein said side wall outer edge diameter is greater than the diameter of said inner surface of said container wall.

4. The device of claim 1, wherein said side wall has an arcuate shape.

5. The device of claim 1, wherein at least one of said wall sections extends outwardly from said disk at a smaller angle than the other two wall sections.

6. The device of claim 1, wherein said device includes a handle to enable insertion and removal of said device from said container, said handle extending upwardly from said disk.

7. The device of claim 6, wherein said handle defines a cavity and is compressible.

8. The device claim 7, wherein said handle is in fluid communication through said disk outer edge, wherein compressing said handle causes at least some of the air in said container to be evacuated from said cavity and by said seal perimeter, and subsequent release of said handle causes a partial cavity that aids in the sealing of said device in said container.

9. The device of claim 1, wherein said substance comprises paint.

10. A device for sealing paint in a can, said can having a cylindrical inner wall having an inner diameter, said device including:

a flat circular disk having an upper and a lower surface, said device intended for fitment within said can, wherein said lower surface presents a flat surface for seating on the paint when said can is generally vertical, said disk including a circular side wall, said side wall including a first section that extends upwardly and angularly from said disk at a first angle, a second section that extends outwardly from said first section and a third section that extends outwardly and angularly from said second section at said first angle, said third section including an outer horizontal rim adapted to contact said can wall, said rim having a perimeter diameter that exceeds the inner wall diameter of said can.

11. The device of claim 10, wherein said rim perimeter exceeds the inner wall diameter of said can by at least approximately 1.0 percent.

12. The device of claim 10, wherein said circular side wall extends radially angularly upwards at an angled rise not less than 10 percent of the inner wall diameter of said can.

13. The device of claim 10, wherein said device includes control means for positioning said device in said can, said control means being capable of functioning as a handle to assist facilitate insertion and removal of said device into and from said can and as a squeeze chamber to facilitate air expulsion from said can during said insertion of said device.

14. The device claim 13, wherein said control means includes a raised cross-sectional mid-portion carried to the extremity of said flat underside of said device in the form of two raised rib members.

15. The device of claim 10, wherein said device is made from moulded thermoplastic plastics.

16. The device of claim 10, wherein said device is made from transparent material.

17. The device of claim 10, wherein upon insertion of said device into said can, said rim frictionally engages said can inner wall, whereby a sealed device and can wall interface is provided, said sealed interface being maintained during non-vertical and inverted orientation of said can.

* * * * *